US011457742B1

(12) United States Patent
Zhang

(10) Patent No.: US 11,457,742 B1
(45) Date of Patent: Oct. 4, 2022

(54) MODULAR SOFA

(71) Applicant: Haoming Zhang, Dongguan (CN)

(72) Inventor: Haoming Zhang, Dongguan (CN)

( * ) Notice: Subject to any disclaimer, the term of this patent is extended or adjusted under 35 U.S.C. 154(b) by 0 days.

(21) Appl. No.: 17/647,865

(22) Filed: Jan. 13, 2022

(51) Int. Cl.
*A47C 4/02* (2006.01)
*A47C 17/02* (2006.01)

(52) U.S. Cl.
CPC ..... *A47C 4/028* (2013.01); *A47C 17/02* (2013.01)

(58) Field of Classification Search
CPC ..... A47C 4/028
USPC ..... 297/440.1, 440.14
See application file for complete search history.

(56) References Cited

U.S. PATENT DOCUMENTS 4,067,073 A * 1/1978 Komarov ..... A47C 4/02 297/440.1
4,437,704 A * 3/1984 Hovsepians ..... A47C 4/02 297/440.17
4,932,721 A * 6/1990 Anthony ..... A47C 4/54 297/440.1 X
5,080,438 A * 1/1992 Moyer ..... A47C 4/028 297/440.23
5,738,414 A * 4/1998 Wieland ..... A47C 4/02 297/440.1
6,217,120 B1 * 4/2001 Pugliese ..... A47C 3/00 297/440.1
6,241,317 B1 * 6/2001 Wu ..... A47C 4/02 297/440.1
6,367,880 B1 * 4/2002 Niederman ..... A47C 4/02 297/440.16
6,796,614 B1 * 9/2004 Paul ..... A47C 7/42 297/440.14 X
6,827,407 B2 * 12/2004 Niederman ..... A47C 4/02 297/440.14
7,140,690 B2 * 11/2006 White ..... A47C 4/03 297/440.14
7,252,339 B2 * 8/2007 Owens ..... A47C 7/42 297/440.16
7,387,344 B2 * 6/2008 Yu ..... A47C 4/028 297/440.1
7,922,253 B2 * 4/2011 Chen ..... A47C 4/02 297/440.14 X
8,322,793 B2 * 12/2012 Chen ..... A47C 13/005 297/440.1
8,646,843 B2 * 2/2014 Koch ..... A47C 17/02 297/440.14

(Continued)

FOREIGN PATENT DOCUMENTS

EP 3804570 A1 * 4/2021 ..... A47C 13/005
FR 2699058 A1 * 6/1994 ..... A47C 13/005

(Continued)

*Primary Examiner* — Rodney B White

(57) ABSTRACT

A modular sofa includes a left wearing unit, configured to be worn on a left foot of a user; a right wearing unit, configured to be worn on a right foot of the user; a signal transmitting unit, arranged on one of a left side of the left wearing unit and a right side of the right wearing unit and configured to transmit signals; a signal detecting unit, arranged on the other of the left side of the left wearing unit and the right side of the right wearing unit and configured to detect signals transmitted by the signal transmitting unit; and a prompt unit, electrically connected to the signal detecting unit and configured to prompt the user if the signal detecting unit detects that there are signals transmitted by the signal transmitting unit.

15 Claims, 5 Drawing Sheets

(56) References Cited

U.S. PATENT DOCUMENTS 8,974,139 B2 * 3/2015 Saul ..... A47C 4/02 297/440.1
9,028,003 B2 * 5/2015 Yeh ..... A47C 7/24 297/440.14
11,202,507 B1 * 12/2021 Yi ..... A47C 4/028
2002/0017814 A1 * 2/2002 Niederman ..... A47C 7/42 297/440.16
2002/0093235 A1 * 7/2002 Niederman ..... A47C 4/02 297/440.1 X
2004/0095000 A1 * 5/2004 Durling ..... A47C 13/005 297/440.1 X
2004/0140706 A1 * 7/2004 Harrison ..... A47C 4/02 297/440.23
2005/0179303 A1 * 8/2005 Owens ..... A47C 7/42 297/440.1
2005/0225153 A1 * 10/2005 Ou ..... A47C 17/00 297/440.14
2009/0045666 A1 * 2/2009 Westendorf ..... A47C 13/005 297/440.1
2014/0103695 A1 * 4/2014 Griggs, Jr. ..... A47C 4/02 297/440.1
2014/0239679 A1 * 8/2014 Griggs, Jr. ..... A47C 4/02 297/440.1 X
2016/0088943 A1 * 3/2016 Connor ..... A47C 4/028 297/440.15
2016/0249742 A1 * 9/2016 Xie ..... A47C 4/028 297/440.23
2020/0100592 A1 * 4/2020 Policicchio ..... A47C 17/02
2020/0375362 A1 * 12/2020 Hale ..... A47C 17/04
2021/0068547 A1 * 3/2021 Hodgson ..... A47C 7/42
2021/0274942 A1 * 9/2021 Ha ..... A47C 17/02

FOREIGN PATENT DOCUMENTS

JP 2002045255 A * 2/2002 ..... A47C 4/02
WO WO-2020144458 A1 * 7/2020 ..... A47C 13/00

* cited by examiner

MODULAR SOFA

CROSS-REFERENCE TO RELATED APPLICATIONS

FIELD

The subject matter herein generally relates to furniture, and particularly relates to a modular sofa.

BACKGROUND

Sofa is popular and widely used in all kinds of environments, such as home, office or other office places. Traditional sofas are inconvenient for assembly and transportation due to their heavy weight and large volume.

Usually, the traditional sofa is packed in a whole for transportation. The carrying capacity of transportation vehicles is low because the transportation volume of the sofa is too large, accordingly, the transportation cost of the sofa is relatively high. Furthermore, a sofa with an integrated structure is not convenient for transportation, especially difficult for users to carry to narrow positions, such as porches, apartments, basements and etc. In order to reduce the transportation cost and facilitate transportation of the sofa, some sofas are designed to be capable of being disassembled, packaged and transported, and then rearranged after being delivered to consumers. However, rearrangement of the sofa requires professionals and special tools, which also cause the overall cost of the sofa increased. In addition, sofa capable being disassembled/reassembled is not stable enough for the users to use at ease.

SUMMARY

In order to resolve above-mentioned deficiencies, the present disclosure provides a modular sofa, which is convenient for transportation, simple in structure, stable, and easy to be disassembled/reassembled, and transported.

A modular sofa includes a sofa seat plate including at least two sofa seat plate units; a sofa back plate detachably connected to the sofa seat plate and including at least two sofa back plate units; two sofa side plates, detachably connected to outer sides of the sofa seat plate and the sofa back plate; and a plurality of sofa legs detachably connected to the sofa seat plate. An inner side of each sofa side plate facing the sofa seat plate is provided with a first connecting member, each of the outer sides of the sofa seat plate and the sofa back plate is provided with a second connecting member, the first connecting member is detachably connected to the second connecting member.

In at least one embodiment, the first connecting member comprises two first connecting elements, one of the two first connecting elements is arranged at a lower part of a front side of the sofa side plate unit, and the other of the two first connecting elements is arranged at a middle part of a rear side of the sofa side plate unit.

In at least one embodiment, a rear side of the sofa seat plate is provided with a third connecting member, a front side of the sofa back plate is provided with a fourth connecting member, and the third connecting member is detachably connected to the fourth connecting member.

In at least one embodiment, each of the first connecting member and the third connecting member is provided with a protrusion in a shape of a trapezoid wide at the top and narrow at the bottom, each of the second connecting member and the fourth connecting member is provided with a slot in a shape of a trapezoid wide at the top and narrow at the bottom, the protrusion is configured to be detachably inserted into the slot.

In at least one embodiment, the sofa legs comprise a first sofa leg unit and a second sofa leg unit, the first sofa leg unit is arranged at four corners of the sofa seat plate, and the second sofa leg unit is arranged between two adjacent sofa seat plate units.

In at least one embodiment, the modular sofa further includes a second fixing member, two opposite ends of the second fixing member are connected to two adjacent sofa seat plate units respectively.

In at least one embodiment, the modular sofa further includes a backrest cushion, the backrest cushion is provided with a fifth connecting member, the sofa back plate is provided with a sixth connecting member, the fifth connecting member is detachably connected with the sixth connecting member.

In at least one embodiment, the modular sofa further includes an armrest cushion, the armrest cushion is provided with a seventh connecting member, the sofa side plate unit is provided with an eighth connecting member, the seventh connecting member is detachably connected to the eighth connecting member.

In at least one embodiment, the backrest cushion and the armrest cushion are made of elastic material.

In at least one embodiment, a bottom side of the sofa seat plate is provided with an accommodation slot configured to accommodate the sofa back plates, the backrest cushion and the armrest cushion.

In at least one embodiment, when the modular sofa is in a disassembled state, the sofa back plate units are stacked up and down, the sofa seat plate units are stacked on upper and lower sides of the sofa seat plates respectively, the sofa side plates, the backrest cushion in a compressed state, and the armrest cushion in a compressed state are accommodated in the accommodation slot to make the modular sofa into a cubic sofa transportation module.

In at least one embodiment, the fifth connecting member, the sixth connecting member, the seventh connecting member and eighth connecting member are zippers, magic taps, buckles or buttons.

In at least one embodiment, a length of the sofa transportation module is a, a width of the sofa transportation module is b, a height of the sofa transportation module is c, b is not less than c, and b is not greater than a.

In at least one embodiment, $(b+c)*2+a<130$ inches.

In at least one embodiment, $(b+c)*2+a<165$ inches.

In at least one embodiment, the modular sofa further includes a first fixing member, and two opposite ends of the first fixing member are connected to two adjacent sofa back plate units.

Through the modular sofa, the sofa side plates are connected to the sofa seat plate and the sofa back plate through the first connecting member and the second connecting member. The sofa side plates are connected to both the sofa seat plate and the sofa back plate, which makes connections among the sofa side plates and the sofa seat plate and the sofa back plate more stable, thus enhancing stability of the sofa. The sofa seat plat, the sofa back plate, the sofa side plates and the sofa legs are detachably connected, which makes the sofa convenient for assembling/disassembling, transportation, storage and use.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION

Figure 1:
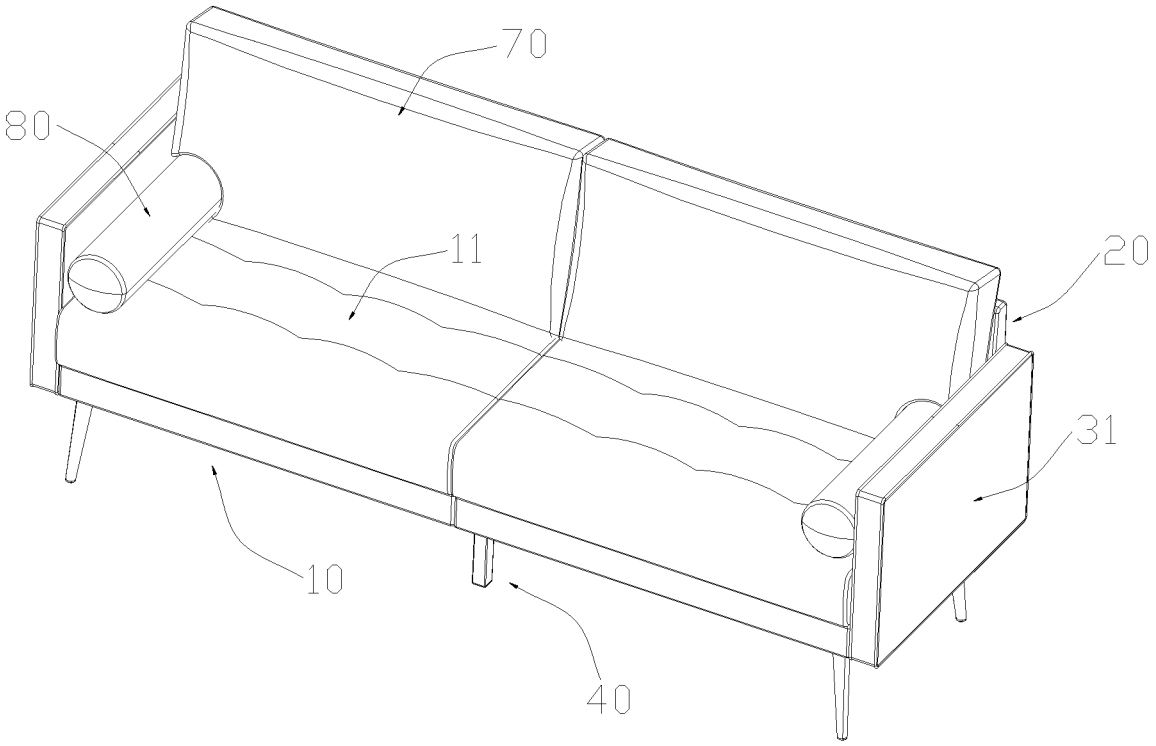
FIG. 1 is a schematic view of a modular sofa according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "a plurality of" means two or more, unless otherwise specifically defined.

Figure 2:
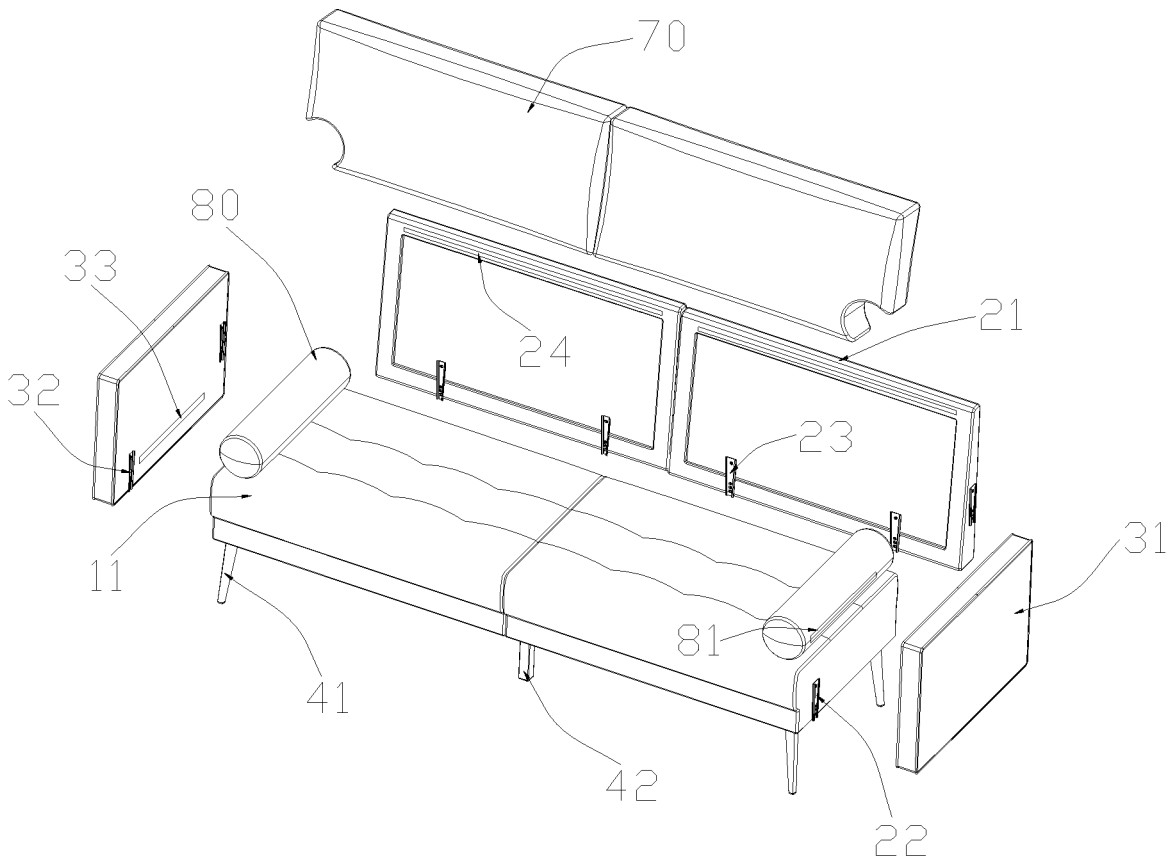
FIG. 2 is an exploded view of the modular sofa of FIG. 1 from a first perspective angle.
Figure 3:
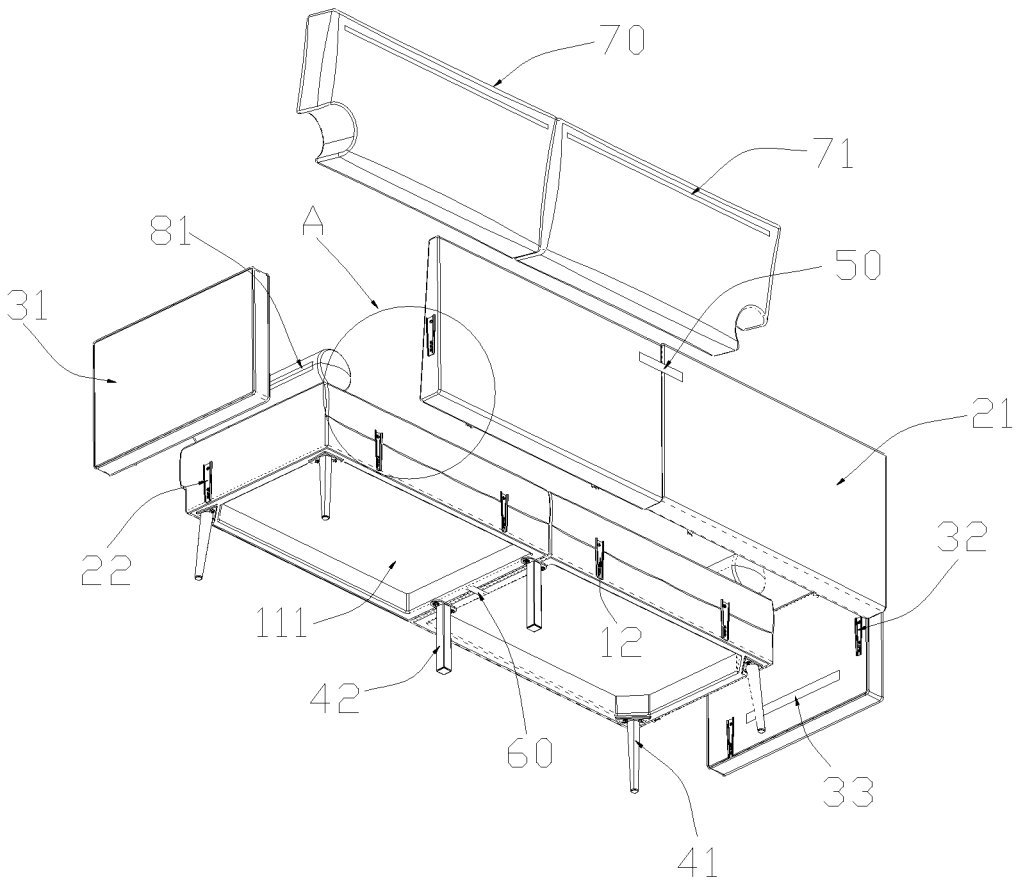
FIG. 3 is an exploded view of the modular sofa of FIG. 1 from a second perspective angle.
Figure 4:
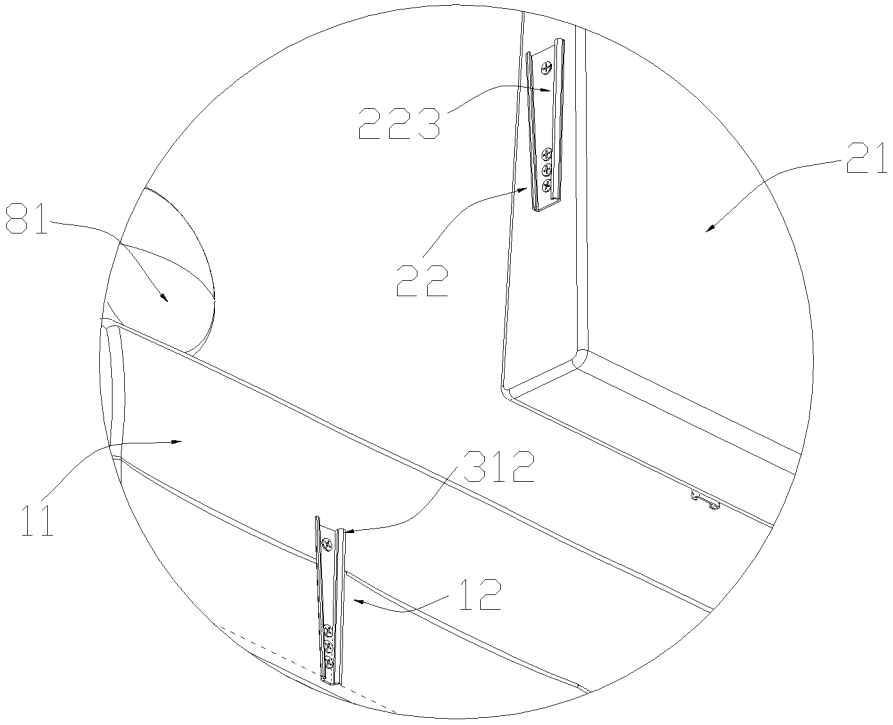
FIG. 4 is an enlarged view of the portion A indicated in FIG. 3.
Figure 5:
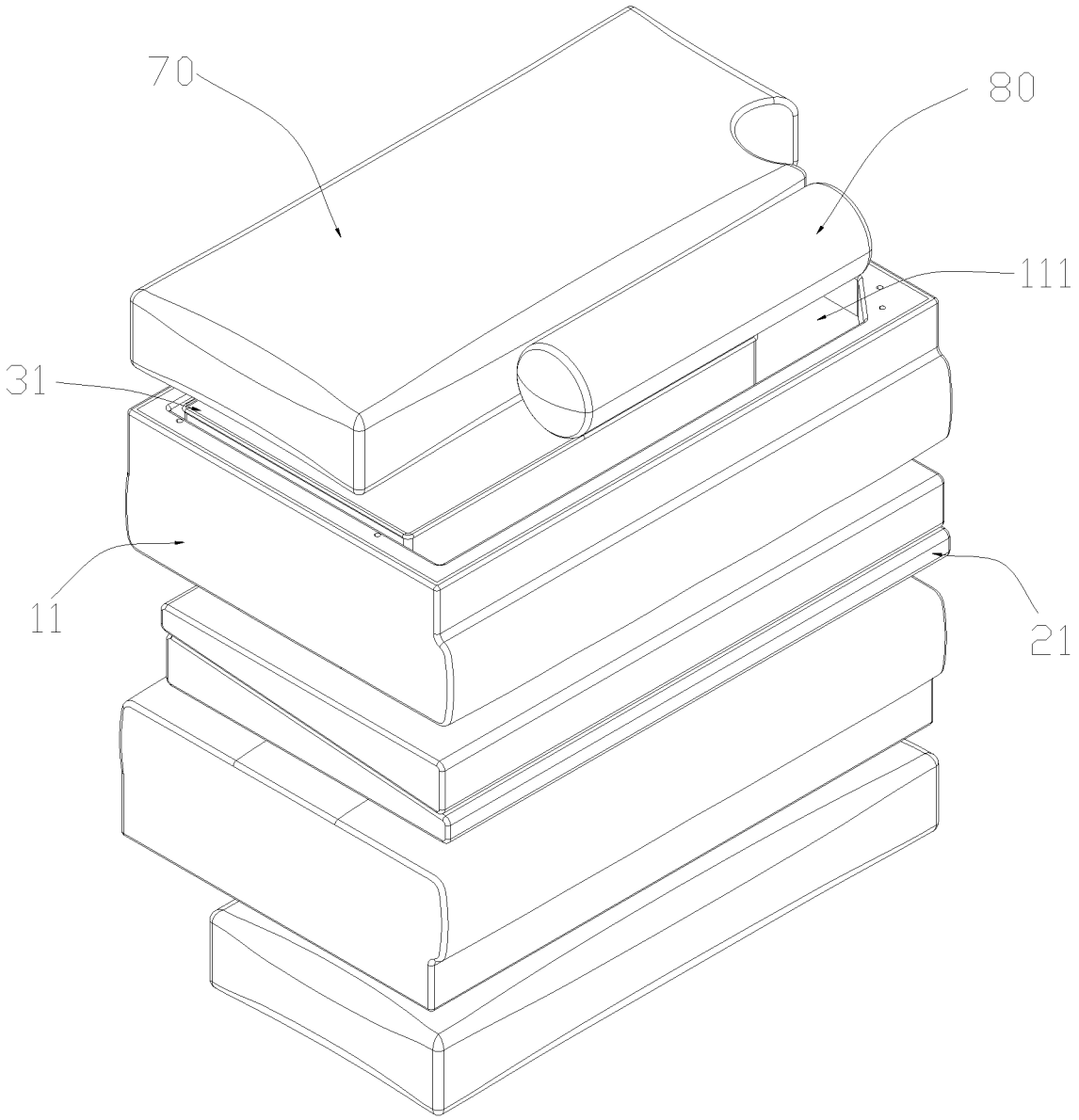
FIG. 5 shows a schematic view of the modular sofa in a disassembled state.

Referring to FIGS. 1-5, FIG. 1 shows a modular sofa. The modular sofa includes a sofa seat plate 10 including at least two sofa seat plate units 11, a sofa back plate 20 detachably connected to the sofa seat plate 10, two sofa side plates 31 detachably connected to two opposite sides of the sofa seat plate 10 respectively, and a plurality of sofa legs 40 detachably connected to a bottom of the sofa seat plate 10. The sofa back plate 20 includes at least two sofa back plate units 21. Each of the sofa side plates 31 is provided with a first connecting member 32 at an inner side thereof facing the sofa seat plate 10. Each of the sofa seat plate 10 and the sofa back plate 20 is provided with a second connecting member 22 at an outer side thereof facing the sofa side plate 31. The first connecting member 32 is detachably connected to the second connecting member 22.

Through such arrangements, the sofa side plates are connected to the sofa seat plate and the sofa back plate through the first connecting member 32 and the second connecting member. The sofa side plates are connected to both the sofa seat plate and the sofa back plate, which makes connections among the sofa side plates and the sofa seat plate and the sofa back plate more stable, thus enhancing stability of the sofa. The sofa seat plat, the sofa back plate, the sofa side plates and the sofa legs are detachably connected, which makes the sofa convenient for assembling/disassembling, transportation, storage and use.

In at least one embodiment, the first connecting member 32 includes two first connecting elements, one of which is arranged at a lower part of a front side of the sofa side plate 31, and the other is arranged at a middle part of a rear side of the sofa side plate 31. Through such arrangements, the two first connecting elements are arranged at the lower part and the middle part of the sofa side plate respectively, which allows the lower part of the sofa side plate to be connected to the outside of the sofa seat plate, the rear part of the sofa side plate to be connected to the outside of the sofa back plate. Two adjacent sides (a lower side and the rear side) of the sofa side plate are connected to the sofa seat plate and the sofa back plate respectively, which further improve stability of the sofa to make the sofa in the assembled state more stable and convenient for users to use at ease.

In at least one embodiment, the sofa seat plate 10 is provided with a third connecting member 12 at a rear side thereof, the sofa back plate 20 is provided with a fourth connecting member 23 at a front side thereof. The third connecting member 12 is detachably connected to the fourth connecting member 23. Through such arrangements, the third connecting member and the fourth connecting member are detachably connected to allow the sofa back plate to be detachably connected to the sofa seat plate, which is convenient for users to assemble/disassemble the sofa.

In at least one embodiment, each of the first connecting member 32 and the third connecting member 12 is provided with a protrusion 312, and each of the second connecting member 22 and the fourth connecting member 23 defines a slot 223 corresponding to the protrusion 312. The protrusion 312 can be detachably arranged inside the slot 223. In at least one embodiment, each of the protrusion 312 and the slot 223 is in a shape of a trapezoid wide at the top and narrow at the bottom. Through such arrangements, each of the first connecting member, the second connecting member, the third connecting member and the fourth connecting member is in a shape of a trapezoid wide at the top and narrow at the bottom, which is convenient for the users to insert the protrusions into the slots respectively to mount the sofa side plates, the sofa back plate and the sofa seat plate together from up to down. The protrusion resists against an inner sidewall defining the slot to achieve firmly connections among the sofa side plates, the sofa back plate and the sofa seat plate. The shape of a trapezoid wide at the top and narrow at the bottom is convenient for users to demount the sofa side plates and the sofa back plate off the sofa seat plate. It is easy to separate the sofa side plates and the sofa back plate from the sofa seat plate just by lifting up the sofa side plates and the sofa back plate.

In at least one embodiment, the sofa legs 40 include a first sofa leg unit 41 and a second sofa leg unit 42. The first sofa leg unit 41 is arranged at four corners of the sofa seat plate 10, and the second sofa leg unit 42 is arranged at a conjunction between the two sofa seat plate units 11.

Through such arrangements, the first sofa leg unit can effectively support the four corners of the sofa seat plate to ensure stability of the sofa, and the second sofa leg unit is connected at the conjunction between the two sofa seat plate units to further support the sofa seat plate so as to make the sofa uniformly stressed and more stable.

In at least one embodiment, the modular sofa further includes a first fixing member 50 connected between two adjacent sofa back plate units 21. Through such arrangements, the first fixing member 50 is configured to connect the two adjacent sofa back plate units to prevent the two adjacent back plate from shaking, thus improving stability of the sofa.

In at least one embodiment, the modular sofa further includes a second fixing member 60 connected between two adjacent sofa seat plate units 11. Through such arrangements, the second fixing member is configured to connect the two adjacent sofa seat plate units together, thus further improving stability of the sofa.

In at least one embodiment, the modular sofa further includes a backrest cushion 70. The backrest cushion 70 is provided with a fifth connecting member 71, and the sofa back plate 20 is provided with a sixth connecting member 24. The fifth connecting member 71 is detachably connected to the sixth connecting member 24. Through such arrangements, the fifth connecting member cooperates with the sixth connecting member, which allows the backrest cushion detachably connected to the sofa back plate. Preferably, the fifth connecting member and the sixth connecting member can be zippers, magic taps (such as Velcro), buckles and buttons, etc., which is simple, convenient for users to operate, costs little and can effectively reduce cost of the sofa.

In at least one embodiment, the modular sofa further includes an armrest cushion 80. The armrest cushion 80 is provided with a seventh connecting member 81, and the sofa side plate 31 is provided with an eighth connecting member 33. The seventh connecting member 81 is detachably connected to the eighth connecting member 33. Through such arrangements, the seventh connecting member cooperates with the eighth connecting member, which allows the armrest cushion detachably connected to the sofa side plate. Preferably, the seventh connecting member and the eighth connecting member can be zippers, magic taps (such as Velcro), buckles and buttons, etc., which is simple, convenient for users to operate, costs little and can effectively reduce cost of the sofa.

In at least one embodiment, the backrest cushion 70 and the armrest cushion 80 are made of elastic materials. Through such arrangements, the elastic material can provide cushioning, which makes part of the sofa directly contacted by users soft and elastic to improve comfort of the sofa. Moreover, the backrest cushion and the armrest cushion made of elastic material can be compressed, which can effectively reduce a volume of the backrest cushion and armrest cushion to facilitate transportation and storage of the sofa, and effectively reduce transportation cost.

In at least one embodiment, the sofa seat plate 11 is provided with accommodation slot 111 configured to accommodate the sofa side plates 31, the backrest cushion 70 and the armrest cushion 80. Through such arrangements, the accommodation slot can effectively accommodate the sofa side plates, the backrest cushion 70 and the armrest cushion 80, which can effectively minimize overall size of the sofa so as to facilitate transportation of the sofa, thus reducing transportation cost.

In at least one embodiment, the sofa back plate units 21 are stacked up and down, the sofa seat plate units 11 are stacked on upper and lower sides of the sofa back plate units 21 respectively, and the sofa side plates 31, the backrest cushion 70 in a compressed state and the armrest pad 80 in a compressed state are accommodated in the accommodation slot 111 to form a rectangular sofa transportation module 100. Through such arrangements, a length and width of the sofa back plate unit and the sofa seat plate unit are basically the same, the sofa back plate units are stacked up and down, the sofa seat plate units are stacked on the upper and lower sides of the sofa back plate units respectively, and the sofa side plates, the backrest cushion and the armrest cushion are accommodated in the accommodation slot to form the sofa transportation module, which effectively reduces a transportation volume of the sofa. Furthermore, the sofa transportation module is substantially cubic, which is convenient for packing, transportation and storage.

In at least one embodiment, a length of the sofa transportation module 100 is a, a width of the sofa transportation module 100 is b, a height of the sofa transportation module 100 is c. The width b of the sofa transportation module 100 is not less than the height c of the sofa transportation module 100, the width b of the sofa transportation module 100 is not greater than the length a of the sofa transportation module 100.

In at least one embodiment, the length a, the width b and the height c of the sofa transportation module 100 meet a formula: $(b+c)*2+a<130$ inches. Through such arrangements, the sofa transportation module meets the formula of $(b+c)*2+a<130$ inches, which allows the sofa transportation module to be transported according to a standard of medium items so as to effectively reduce transportation cost of the sofa and to improve transportation efficiency.

In at least one embodiment, the length a, the width b and the height c of the sofa transportation module 100 meet a formula: $(b+c)*2+a<165$ inches. Through such arrangements, the sofa transportation module meets the formula of $(b+c)*2+a<165$ inches, which allows the sofa transportation module to be transported according to a standard of large items so as to effectively reduce transportation cost of the sofa and to improve transportation efficiency.

The above description only describes embodiments of the present disclosure, and is not intended to limit the present disclosure, various modifications and changes can be made to the present disclosure. Any modifications, equivalent substitutions, improvements, etc. made within the spirit and scope of the present disclosure are intended to be included within the scope of the present disclosure.

What is claimed is:

1. A modular sofa, comprising:

a sofa seat plate, comprising at least two sofa seat plate units;

a sofa back plate, detachably connected to the sofa seat plate and comprising at least two sofa back plate units;

two sofa side plates, detachably connected to outer sides of the sofa seat plate and the sofa back plate;

a plurality of sofa legs, detachably connected to the sofa seat plate;

a backrest cushion; and an armrest cushion;

wherein a bottom side of the sofa seat plate is provided with an accommodation slot configured to accommodate the sofa back plates, the backrest cushion or the armrest cushion;

wherein an inner side of each sofa side plate facing the sofa seat plate is provided with a first connecting member, each of the outer sides of the sofa seat plate and the sofa back plate is provided with a second connecting member, the first connecting member is detachably connected to the second connecting member.

2. The modular sofa according to claim 1, wherein the first connecting member comprises two first connecting elements, one of the two first connecting elements is arranged at a lower part of a front side of the sofa side plate unit, and the other of the two first connecting elements is arranged at a middle part of a rear side of the sofa side plate unit.

3. The modular sofa according to claim 2, wherein a rear side of the sofa seat plate is provided with a third connecting member, a front side of the sofa back plate is provided with a fourth connecting member, and the third connecting member is detachably connected to the fourth connecting member.

4. The modular sofa according to claim 3, wherein each of the first connecting member and the third connecting member is provided with a protrusion in a shape of a trapezoid wide at the top and narrow at the bottom, each of the second connecting member and the fourth connecting member is provided with a slot in a shape of a trapezoid wide at the top and narrow at the bottom, the protrusion is configured to be detachably inserted into the slot.

5. The modular sofa according to claim 1, wherein the sofa legs comprise a first sofa leg unit and a second sofa leg unit, the first sofa leg unit is arranged at four corners of the sofa seat plate, and the second sofa leg unit is arranged between two adjacent sofa seat plate units.

6. The modular sofa according to claim 1, wherein, the backrest cushion is provided with a fifth connecting member, the sofa back plate is provided with a sixth connecting member, the fifth connecting member is detachably connected with the sixth connecting member.

7. The modular sofa according to claim 6, wherein, the armrest cushion is provided with a seventh connecting member, the sofa side plate unit is provided with an eighth connecting member, the seventh connecting member is detachably connected to the eighth connecting member.

8. The modular sofa according to claim 7, wherein the fifth connecting member, the sixth connecting member, the seventh connecting member and eighth connecting member are zippers, magic taps, buckles or buttons.

9. The modular sofa according to claim 7, wherein the backrest cushion and the armrest cushion are made of elastic material.

10. The modular sofa according to claim 1, wherein when the modular sofa is in a disassembled state, the sofa back plate units are stacked up and down, the sofa seat plate units are stacked on upper and lower sides of the sofa seat plates respectively, the sofa side plates, the backrest cushion in a compressed state, and the armrest cushion in a compressed state are accommodated in the accommodation slot to make the modular sofa into a cubic sofa transportation module.

11. The modular sofa according to claim 1, wherein a length of the sofa transportation module is a, a width of the sofa transportation module is b, a height of the sofa transportation module is c, b is not less than c, and b is not greater than a.

12. The modular sofa according to claim 11, wherein $(b+c)*2+a<130$ inches.

13. The modular sofa according to claim 11, wherein $(b+c)*2+a<165$ inches.

14. The modular sofa according to claim 1, further comprising a first fixing member, and two opposite ends of the first fixing member are connected to two adjacent sofa back plate units.

15. The modular sofa according to claim 1, further comprising a second fixing member, two opposite ends of the second fixing member are connected to two adjacent sofa seat plate units respectively.

* * * * *